United States Patent [19]

Hasse et al.

[11] 4,345,293

[45] Aug. 17, 1982

[54] ARRESTER

[75] Inventors: Peter Hasse, Neumarkt; Johannes Wiesinger, Puchheim; Erich Pivit, Allmersbach, all of Fed. Rep. of Germany

[73] Assignees: Dehn + Söhne + Co. KG, Nuremberg; AEG-Telefunken Aktiengesellschaft, Frankfurt and Berlin, both of Fed. Rep. of Germany

[21] Appl. No.: 179,704

[22] Filed: Aug. 20, 1980

[30] Foreign Application Priority Data

Aug. 24, 1979 [DE] Fed. Rep. of Germany ..... 2934237

[51] Int. Cl.[3] ..... H01T 1/02

[52] U.S. Cl. ..... 361/117; 313/240; 313/325

[58] Field of Search ..... 361/117, 120; 313/205, 313/240, 242, 268, 217, 231.1, 231.2, 325

[56] References Cited

U.S. PATENT DOCUMENTS

| | | | |
|---|---|---|---|
| 2,397,982 | 4/1946 | Salzberg | 313/240 X |
| 2,802,150 | 8/1957 | Yonkers, Jr. | 361/130 X |
| 3,723,819 | 3/1973 | Charewicz | 313/325 X |
| 3,798,484 | 3/1974 | Rich | 361/120 X |

*Primary Examiner*—Harry E. Moose, Jr.

*Attorney, Agent, or Firm*—Spencer & Kaye

[57] ABSTRACT

In an overvoltage arrester composed of two electrodes spaced apart to define a gas spark gap presenting an arc discharge region, and a spacer member of insulating material interposed between the electrodes and forming with the electrodes the walls of a chamber communicating with the arc discharge region, elements are disposed in the chamber to establish therein a labyrinth gas flow path between the arc discharge region and the spacer member.

7 Claims, 3 Drawing Figures

ARRESTER

BACKGROUND OF THE INVENTION

The present invention relates to an overvoltage arrester having a gas spark gap presenting an arc discharge region and provided with a spacer consisting of an insulating material for the electrodes and with a chamber adjoining the arc discharge region, the walls of this chamber being constituted by the two electrodes and the spacer.

Such arresters are conventional, as disclosed, for example, in the article "Protection of Electronic and Telecommunications Systems with Spark Gap" in *Nachrichten-Elektronik* [Communication Electronics]4: 127–130 (1979). The arresters described in this article present in most cases two- or three-electrode spark gaps with a hermetically sealed gas filling. Such spark gaps are suitable for protecting telecommunication cables or receiving antennas against lightning flashovers, but are adequate only for operative insulation and do not meet the increased requirements for protective insulation.

FRG DOS 2,641,858 likewise discloses an overvoltage protector for telecommunication lines consisting of a structure forming a spark gap between two carbon electrodes, an area being provided around the zone of arc discharge serving as an outlet for particles escaping from the electrodes into the gap. This spark gap, too, suffices merely for operative insulation and moreover exhibits an only very limited lifetime.

SUMMARY OF THE INVENTION

Therefore, it is an object of the invention to provide an arrester of the type mentioned hereinabove, having an insulation resistance, a dielectric strength and an operating reliability in the nonignited condition which are equivalent to the protective insulation defined in VDE 0845 (Specification of the Association of German Electrical Engineers (VDE)), and presenting a threshold voltage which is lower than the dielectric strength of protective insulation.

A further object is to provide an arrester which, in the ignited condition, limits the voltage to harmless values and is capable of absorbing repeatedly full lightning current without impairing the functions of the arrester to such an extent that the above requirements are no longer met.

A more specific object of the invention is to provide a structure which prevents or inhibits vapor deposition of electrically conductive plasma particles on the spacer, which latter is governing for the protective insulation, and thus prevents or inhibits a lowering of the insulation resistance of this spacer.

These an other objects are achieved by the provision, in an overvoltage arrester composed of two electrodes spaced apart to define a gas spark gap presenting an arc discharge region and a spacer member of insulating material interposed between the electrode and forming with the electrodes the walls of a chamber communicating with the arc discharge region, of means associated with the chamber for establishing therein a labyrinth gas flow path between the arc discharge region and the spacer member.

The arrester according to the present invention exhibits the advantages that high leakage currents can be removed thereby, that, in the nonignited condition, there exist high dielectric strength, great reliability, and a high insulation resistance, and that these properties remain preserved even after many strong lightning strikes. The arrester thus fulfills the basic requirements for protective insulation, insofar as its threshold voltage is correspondingly lower than the dielectric strength of the protective insulation, which can be achieved by conventional means. In a suitable combination with one or more arresters satisfying the requirements of operative insulation and capable of self-sustained extinction of the arc of the mains current after ignition by an overvoltage, in accordance with the requirements of VDE 0675, Part 1, the arrester of this invention can thus entirely and completely fulfill the requirements for protective insulation, necessitating neither additional grounding measures nor potential-compensating measures. Reference is made in this connection to Application Serial No. filed on or about the same date of the present application for POWER CONNECTOR WITH OVERVOLTAGE PROTECTION and claiming priority of FRG Application No. P 29 34 235.6 of Aug. 24, 1979.

One example of an arrester satisfying the requirements of VDE 0675, Part 1, is disclosed in our copending application Ser. No. 179,706, filed on Aug. 20, 1980 for ARRESTER WITH SPARK GAP and claiming priority of FRG Application No. P 29 34 236.7 of Aug. 24, 1979. This is an arrester for limiting overvoltages in a low voltage power system and for coupling conductors which are normally resistively separated from one another for lightning protection, which arrester includes at least two electrodes spaced apart to define at least one spark gap forming an arc discharge region, and insulating means holding the electrodes in spaced-apart relation, the arrester being provided with means defining a first chamber adjacent the arc discharge region and providing a chamber wall of an insulating material which emits a quenching gas under the effect of heat and provided with at least one outlet aperture through which the gases emitted under the effect of the heat generated during arc discharge can escape.

DESCRIPTION OF THE PREFERRED EMBODIMENTS

Figure 1:
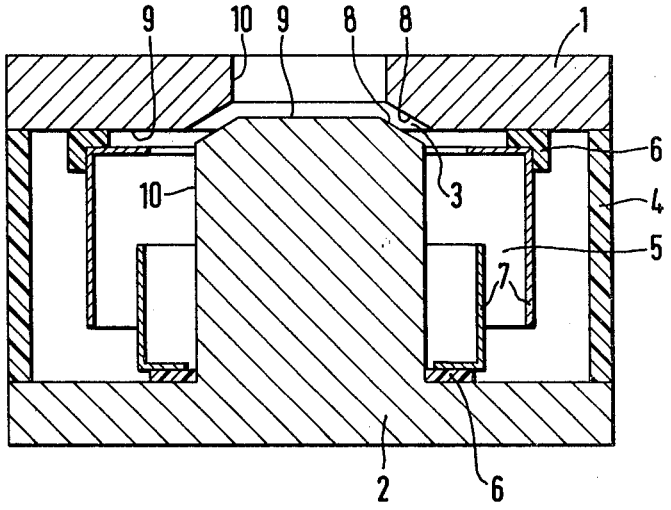
FIG. 1 is a cross-sectional view of an axially symmetrical embodiment of the invention.
Figure 2B:
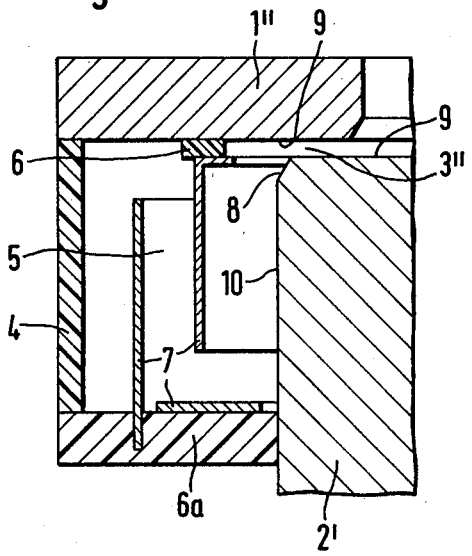
FIGS. 2*a* and 2*b* are cross-sectional views of one-half of further axially symmetrical embodiments of the invention.
Figure 2A:
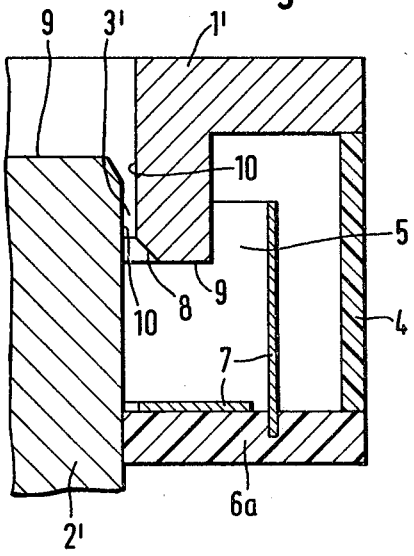

FIG. 1 shows an advantageous embodiment of the invention in the form of an axially symmetrical arrangement of an electrode 1 in the form of a perforated disc having an inner cylindrical lateral surface 10, and of an electrode 2 arranged therebeneath and having the shape of a solid cylinder. Electrodes 1 and 2 have respective chamfered inner and outer edges 8. These two chamfered edge surfaces delimit an arc discharge region 3 which, in the absence of an arc constitutes a gas, and preferably air, insulator. A spacer 4 is provided between the outer rim of the disc-shaped, lower extension of the electrode 2 and the outer rim of the electrode 1 at a location far removed from the region of arc discharge 3. During an arc discharge a mass of gas under pressure is formed in the discharge zone 3. Most of this gas can escape upwardly from region 3. However, it is unavoidable that a relatively small portion of the gas will be urged into the chamber 5 delimited by the electrodes 1 and 2 and the spacer 4.

Chamber 5 is fashioned in the form of a labyrinth in such a way that an artificial lengthening of the path of the gases to the spacer, as well as cooling, are provided. This provides the advantage of preventing or minimizing vapor deposition of metal particles torn away from the electrodes during the arc discharge on the inner surface of the spacer; this is an absolute prerequisite for a permanently and unrestrictedly effective protective insulation. Cooling is accomplished through the metal walls 7 of the labyrinth which exhibit high heat conductivity. These walls are mounted in an insulated fashion via insulating supports 6 on the electrodes 1 and 2 to prevent a spreading of the arc discharge to the zone of the labyrinth.

By means of such a labyrinth arrangement, it is made possible that a major part of the material in the gases produced during arc discharge can be deposited at the inlet on the labyrinth walls, so that the insulation value of the spacer, and thus of the spark gap, is not substantially impaired even after many high loads due to currents produced by lightning strikes. Advantageously, wear and tear can be kept at a very low value by making each of electrodes 1 and 2 of a suitable electrode material, for example, tungsten-copper, exhibiting a high resistivity against burn-off.

With an appropriate construction of the electrodes, the arc can be maintained stably in the air gap provided therefor, and thus a vapor deposition on the spacer-insulator can likewise be counteracted.

An advantageous feature of arresters according to the invention is that after cessation of a discharge, the air spark gap is blown through from the inside toward the outside, due to the excess pressure in the chamber, and thus the spark gap is cleansed.

A typical feature of arresters constructed according to this invention resides in that these arresters, after an accumulated load corresponding to approximately a thousand statistically averaged lightning strikes but also including above-average lightning current loads, are still fully operable and exhibit an insulation resistance of $<10^{10}\Omega$. A melting of the electrodes, or even merely tendencies toward such melting, could not be observed.

Two further embodiments of the invention are shown in FIGS. *2a* and *2b*, each illustrating one-half of an axially symmetrical structure. In the embodiment shown in FIG. *2a*, the lower electrode 2' projects with its end face 9 and its outer lateral surface 10 far into the aperture of the hollow-cylindrical inner portion of electrode 1', so that the arc discharge can develop in the region 3' between the opposed parts of the cylindrical lateral surfaces 10. The labyrinth 5 is formed, on the one hand by the beveled surface 8, and the end face 9 of electrode 1', as well as by the other lateral surface that extends from face 9 and by the lower surface of the washer-shaped outer portion of the electrode 1' adjoining the upper end of the inner hollow-cylindrical portion, as well as by metal walls 7 mounted on a washer-shaped insulating member 6a encompassing and connected to the electrode 2', and by the spacer 4 constituting the outward radial boundary of the arrester.

In the embodiment shown in FIG. *2b*, the end faces 9 of the two cylindrical electrodes 1'' and 2' delimit the arc discharge region 3''. By means of this arrangement, discharge is rendered especially stable, so that there is even less of a possibility of vapor deposition on the spacer 4. The well-formed labyrinth 5 here consists of three chambers which are formed by three metal walls 7, a disc-shaped insulating member 6a encompassing and connected to the electrode 2 and to which are mounted two of the metal walls 7, and an insulating member 6 with which the third metal wall is attached to the upper electrode 1.

For the arresters in FIGS. 1, *2a*, *2b*, a typical tungsten copper alloy is 20% copper; 80% tungsten; a specific material for spacer 4 and support 6 is a fibre reinforced epoxy. The material for walls 7 is brass, the insulation level provided by spacer 4 is $10^4$ MΩ. Typical dimensions for the gap are 1 to 2 mm with a diameter of the central electrode of 15 to 25 mm. The typical length of the labyrinth path defined by chamber 5 may be up to 10 cm. Typical breakdown voltage of the gap is 3 to 5 KV and the arc discharge voltage is below 50 Volts.

It will be understood that the above description of the present invention is susceptible to various modifications, changes and adaptations, and the same are intended to be comprehended within the meaning and range of equivalents of the appended claims.

What is claimed is:

1. In an overvoltage arrester composed of two electrodes spaced apart to define a gas spark gap presenting an arc discharge region, a spacer member of insulating material interposed between the electrodes and forming with the electrodes the walls of a chamber communicating with the arc discharge region, and means associated with the chamber for establishing therein a labyrinth gas flow path between the arc discharge region and the spacer member, the improvement wherein one of said electrodes has the form of a solid cylinder and the other of said electrodes has the form of a disk with an essentially central bore which serves as a discharge opening leading into the open air near said arc discharge region to permit rapid escape of hot gas collecting in the chamber under excess pressure as the result of an arc discharge.

2. An arrester according to claim 1 wherein said chamber and said means are of materials having high heat conductivity.

3. An arrester according to claim 2 wherein said means include metal walls and all said metal walls are mounted to be insulated from said electrodes.

4. An arrester according to claim 3 wherein said spacer member is arranged at a distance from the arc discharge region.

5. An arrester according to claim 1, 2, 3 or 4 wherein said chamber has an axially symmetrical form, each said electrode presents a beveled edge facing the other said electrode and said arc discharge region is located primarily between opposed surfaces of said electrodes.

6. An arrester according to claim 5 wherein each said electrode is made of a metal alloy having a high resistance to burn-off.

7. An arrester according to claim 1, 2, 3 or 4 wherein each said electrode is made of a metal alloy having a high resistance to burn-off.

* * * * *